US009429376B2

(12) United States Patent
Davison et al.

(10) Patent No.: US 9,429,376 B2
(45) Date of Patent: Aug. 30, 2016

(54) MANUAL GAU-21 CHARGER

(71) Applicant: Contract Fabrication and Design, Princeton, TX (US)

(72) Inventors: Jesse L. Davison, McKinney, TX (US); Chris Fellegy, Sadler, TX (US); Jarrett O'Hara, Plano, TX (US); David A. Dierks, McKinney, TX (US); Marvin Vale Riggall, Jr., Nevada, TX (US)

(73) Assignee: Contract Fabrication & Design, LLC, Princeton, TX (US)

( * ) Notice: Subject to any disclaimer, the term of this patent is extended or adjusted under 35 U.S.C. 154(b) by 0 days.

(21) Appl. No.: 14/879,613

(22) Filed: Oct. 9, 2015

(65) Prior Publication Data

US 2016/0109199 A1 Apr. 21, 2016

Related U.S. Application Data

(60) Provisional application No. 62/064,738, filed on Oct. 16, 2014.

(51) Int. Cl.
*F41A 3/72* (2006.01)

(52) U.S. Cl.
CPC ..... *F41A 3/72* (2013.01)

(58) Field of Classification Search
CPC ..... F41A 7/00; F41A 7/02; F41A 3/72
USPC ..... 89/1.4
See application file for complete search history.

(56) References Cited

U.S. PATENT DOCUMENTS

| | | | | | |
|---|---|---|---|---|---|
| 2,293,069 | A * | 8/1942 | McNeill | F41A 25/14 | 89/37.08 |
| 2,332,631 | A * | 10/1943 | Gasser | F41A 7/02 | 74/471 R |
| 2,384,834 | A * | 9/1945 | Grant, Jr. | F41A 7/04 | 89/1.4 |
| 2,389,737 | A * | 11/1945 | Neuschotz | F41A 19/08 | 74/506 |
| 2,451,614 | A * | 10/1948 | Burns | F41A 7/02 | 89/136 |
| 2,576,015 | A * | 11/1951 | Humphrey | F41A 7/06 | 89/1.4 |
| 2,789,466 | A * | 4/1957 | Summers | F41A 7/02 | 89/1.4 |
| 2,810,325 | A * | 10/1957 | Deslierres | F41A 7/02 | 89/1.4 |
| 2,845,001 | A * | 7/1958 | Hillberg | F41A 7/02 | 89/1.4 |
| 4,531,444 | A * | 7/1985 | Jackson | F41A 7/02 | 89/1.4 |
| 7,827,896 | B2 * | 11/2010 | Hektoen | F41A 7/02 | 89/1.4 |
| 2015/0276337 | A1 * | 10/2015 | Crouse | F41A 3/72 | 89/1.4 |

* cited by examiner

*Primary Examiner* — Bret Hayes
(74) *Attorney, Agent, or Firm* — Harness Dickey & Pierce PLC; Robert C. Klinger

(57) ABSTRACT

A mechanical gun charger configured to charge a gun, including a cradle configured to support the gun. A lever is rotatably coupled to the cradle, wherein an outboard cable coupled between the lever and a first pulley is configured such that displacement of the lever causes the first pulley, a shaft, and a second pulley to rotate. A charging cable is coupled to the second pulley and is configured to couple to and charge the gun upon rotation of the second pulley.

20 Claims, 7 Drawing Sheets

MANUAL GAU-21 CHARGER

CLAIM OF PRIORITY

This application claims priority under 35 U.S.C. Section 119(e) of U.S. Provisional Patent application Ser. No. 62/064,738 filed Oct. 16, 2014 entitled MANUAL GAU-21 CHARGER, the teachings of which are included herein in their entirety.

TECHNICAL FIELD

This disclosure provides a manual charger mechanism for a gun, such as a GAU-21 gun.

BACKGROUND

A legacy charging design for a GAU-21 weapon does not have acceptable clearances for mounting its cradle externally on aircraft. This disclosure provides a compact charging design that allows the cradle to be mounted externally, such as on an aircraft, with adequate clearances.

The legacy charging design also has charging forces that are too high. This disclosure provides a design that reduces charging forces, making it easier for a user to charge the weapon.

SUMMARY

A mechanical gun charger configured to charge a gun, including a cradle configured to support a gun. A lever is rotatably coupled to the cradle, wherein an outboard cable coupled between the lever and a first pulley is configured such that displacement of the lever causes the first pulley, a shaft, and a second pulley to rotate. A charging cable is coupled to the second pulley and is configured to couple to and charge the gun upon rotation of the second pulley.

DETAILED DESCRIPTION

FIG. 1 through FIG. 7 illustrates a manual charging system 20 configured to charge a gun 10. The charging system 20 includes a geared pulley system which reduces the charging force to manually charge the gun 10.

Figure 1:
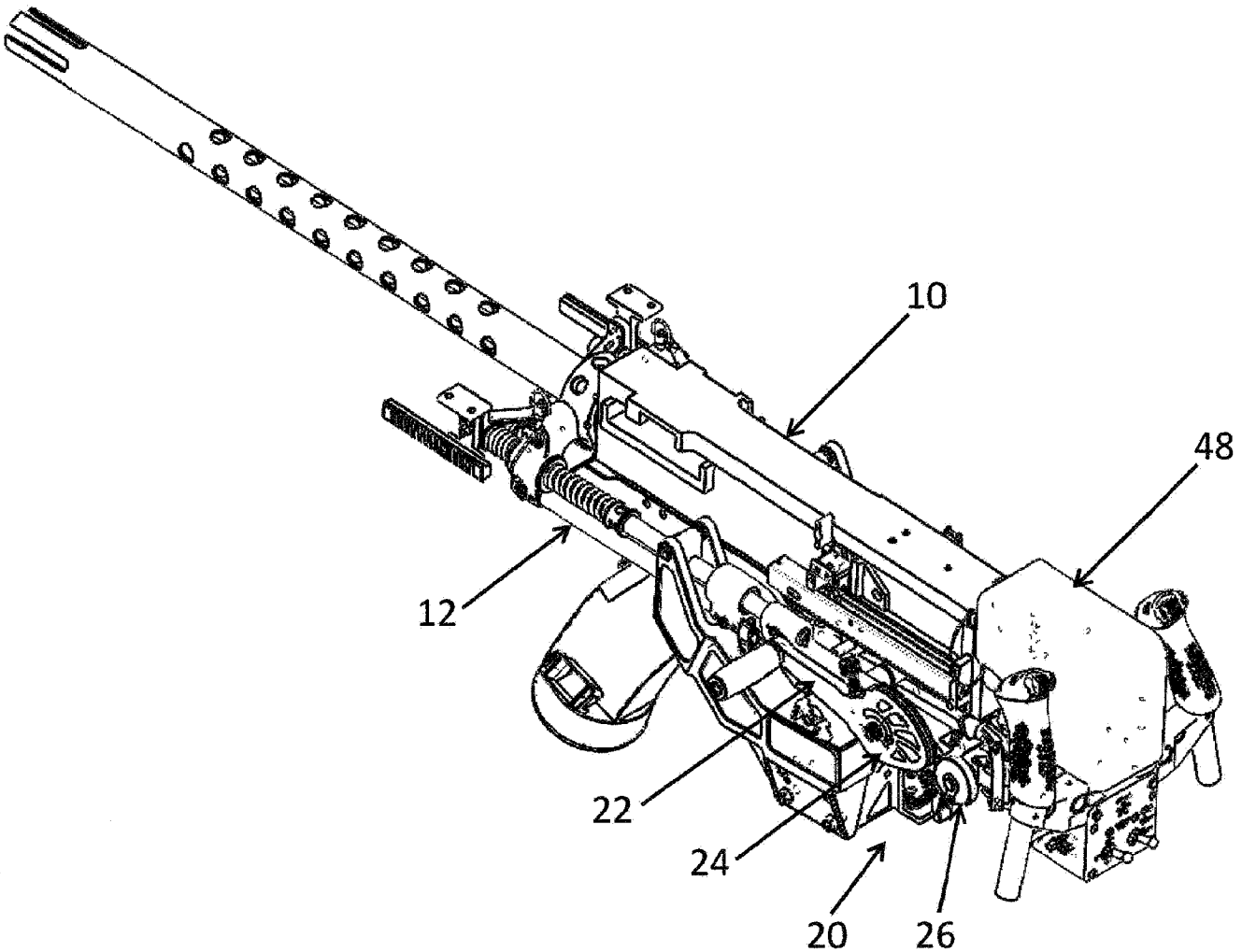
FIG. 1 illustrates a perspective view of a GAU-21 gun placed in a cradle having a manual charging system.
Figure 2:
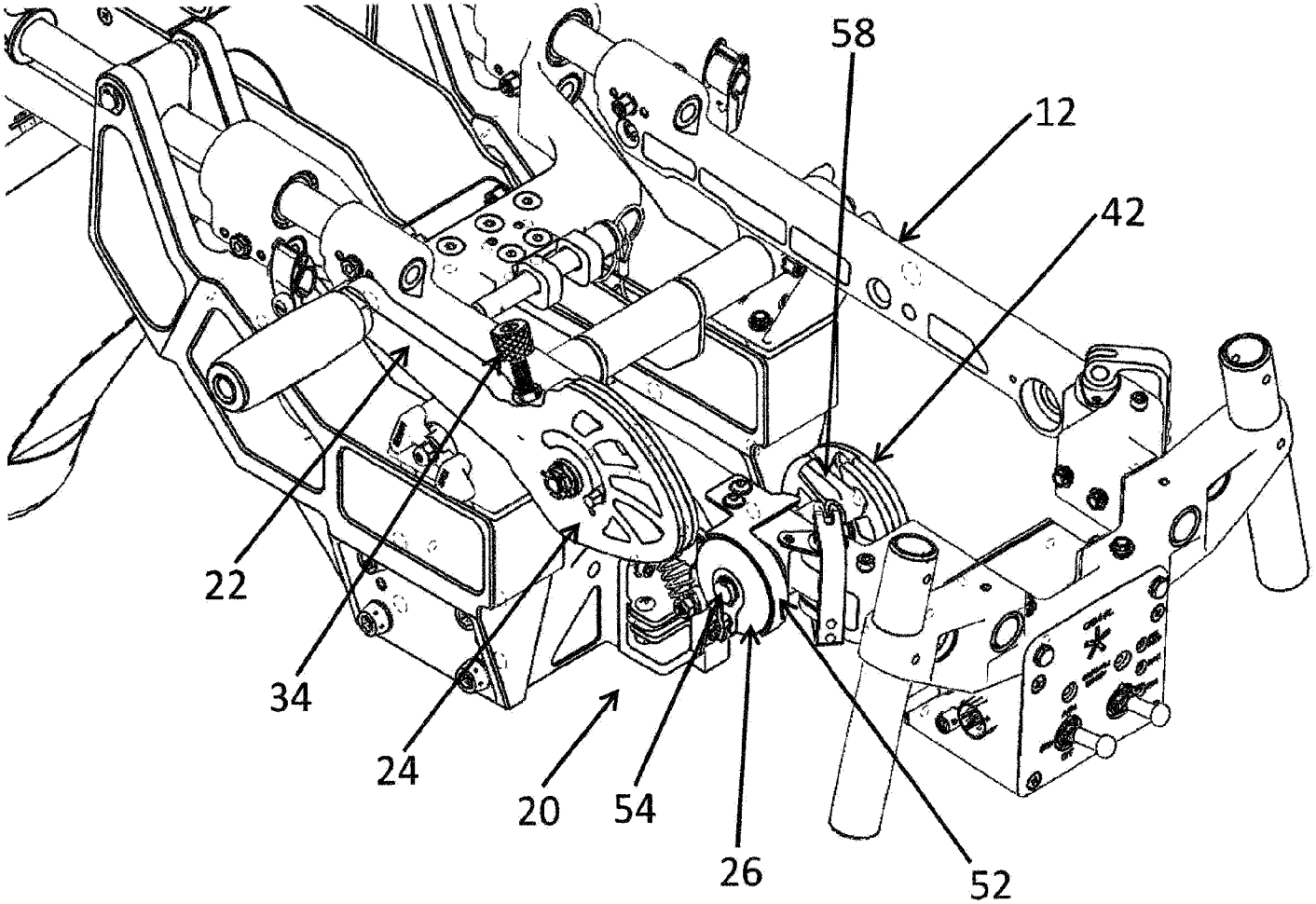
FIG. 2 and FIG. 3 illustrates the manual charging system with the cables removed for clarity.

FIG. 1 illustrates a perspective view of a GAU-21 gun generally shown at 10 in a cradle 12 having a manual charging system generally shown at 20 according to this disclosure.

Figure 3:
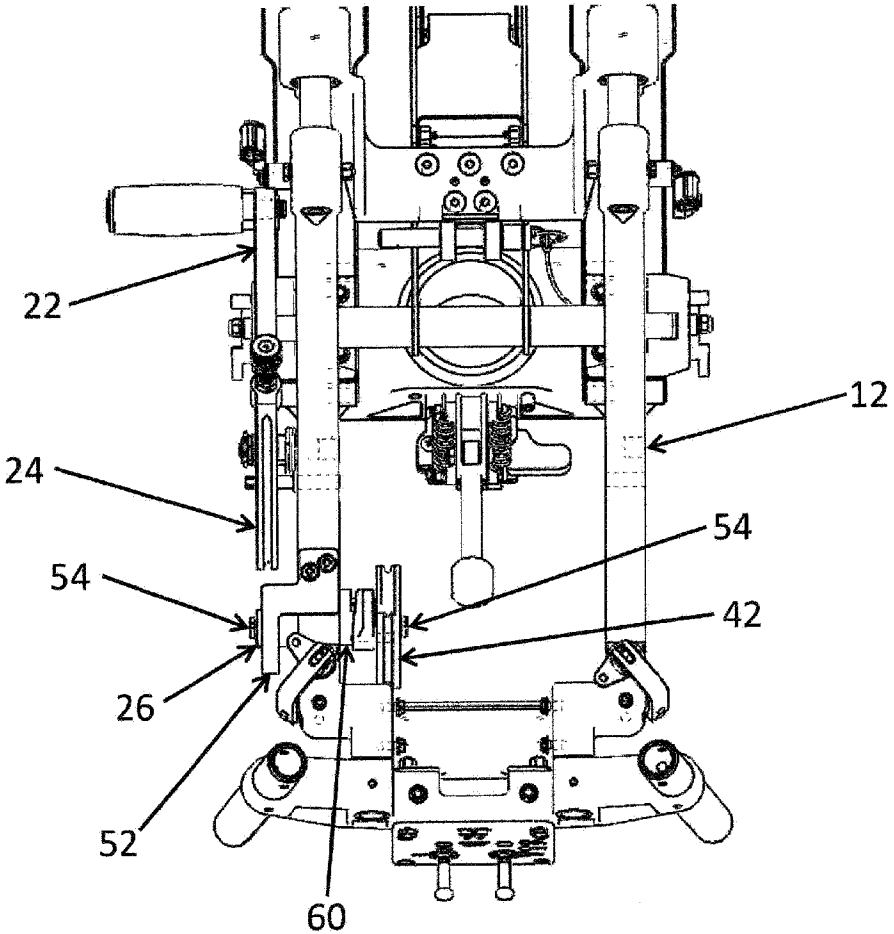
Figure 4:
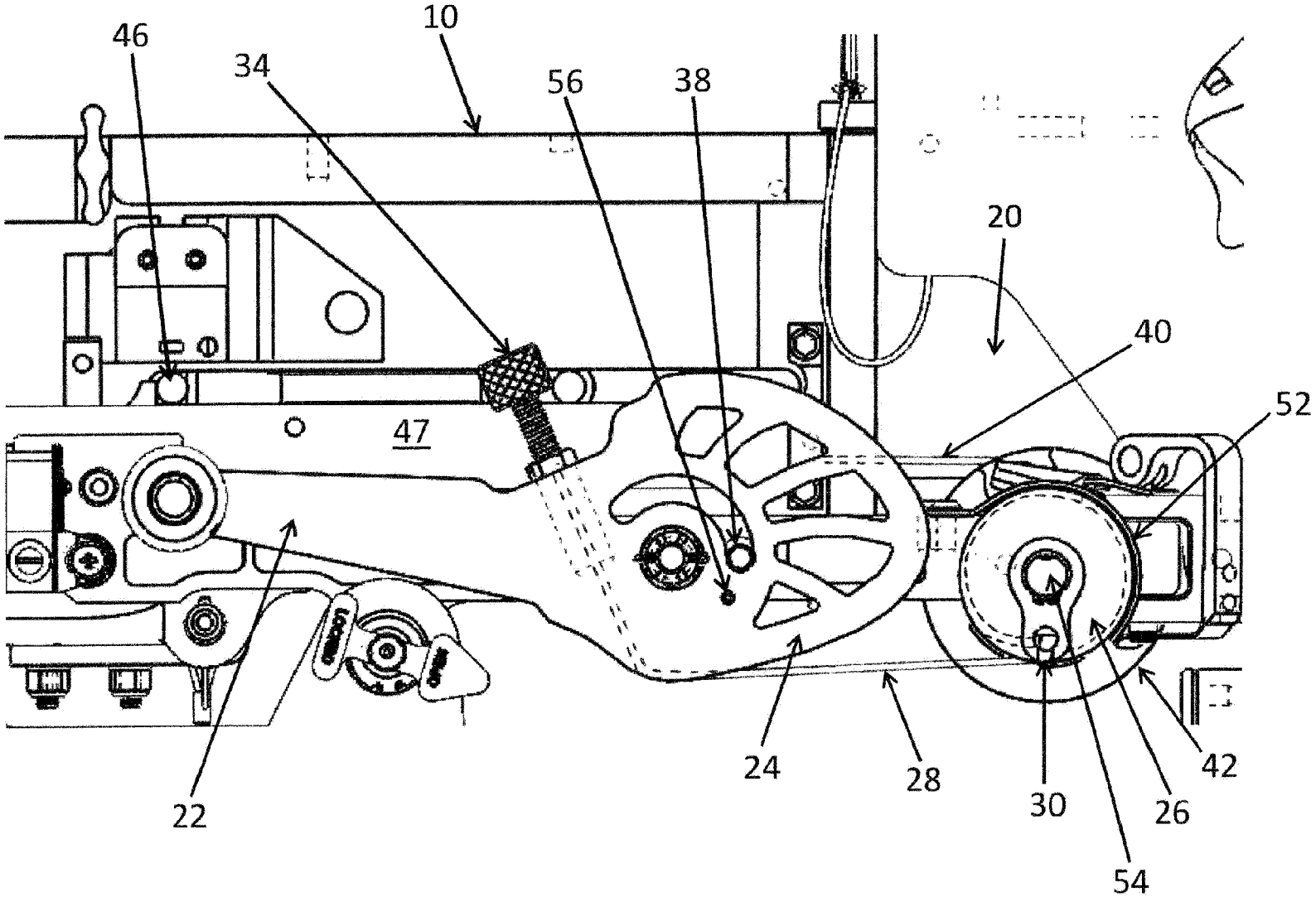
FIG. 4 illustrates an outboard cable that is wrapped once around a tracked perimeter of a small pulley, and then fixed to the small pulley at a point using a quick release ball swage, and a charging cable extending from a gun bolt stud of the gun, and then fixed to the large pulley at point using a quick release latch.
Figure 5:
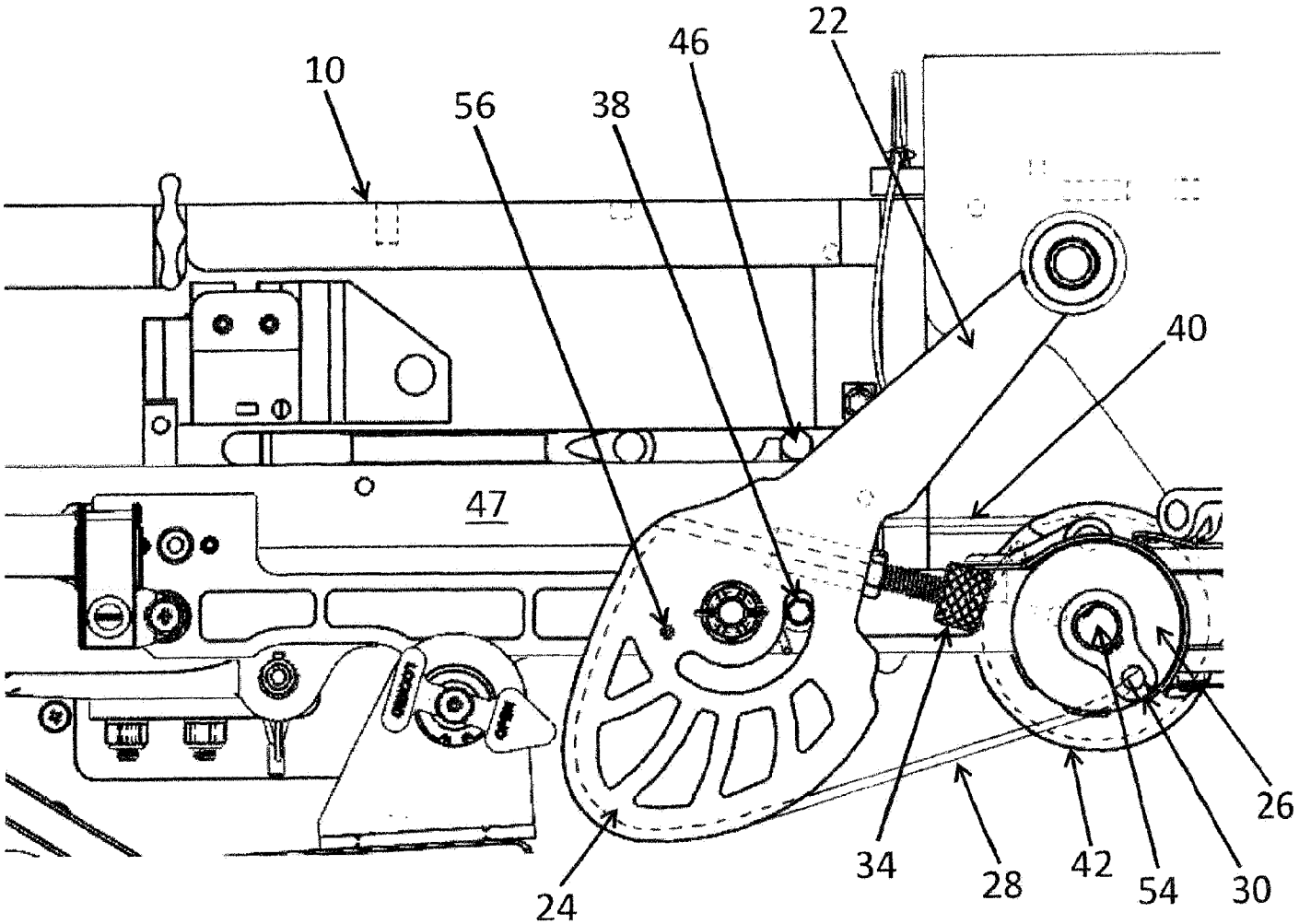
FIG. 5 illustrates a user pulling the charging handle, where the outboard cable pulls the small pulley and consequently the shaft and the large pulley, the large pulley causing the charging cable to pull the gun bolt stud of the gun rearward to charge the weapon.

As shown in FIGS. 1-5, the charging system 20 includes a charging handle 22 having a cam 24 on one end and a lever extending from the cam 24, a small pulley 26, a large pulley 42, an outboard cable 28, and a charging cable 40 which together reduce the charging force. The outboard cable 28 and the charging cable 40 are not shown in FIGS. 1-3 for clarity, and are shown in FIGS. 4-5. The small pulley 26 is rotatably mounted to the outboard left hand (LH) side of the cradle 12. A pulley guard 52 is annularly positioned over a peripheral track of the small pulley 26. Pulley guard 52 encompasses the small pulley 26 and keeps the outboard cable 28 from coming loose and falling off the track on small pulley 26.

As shown in FIG. 4 and FIG. 5, the outboard cable 28 is fastened at one end to the charging handle 22 proximate the cam 24 at thumb screw 34, and to the small pulley 26 at point 30 using a ball swage at the other end. The outboard cable 28 is wrapped once around the small pulley 26 in a peripheral track thereof and is fixed at point 30 to the small pulley 26 in order to set the rotational direction. The small pulley 26 is secured to an outside end portion of a shaft 54 at one end of the shaft 54, and the large pulley 42 is secured to an inside end portion at the other end of the shaft 54, behind the gun 10. The small pulley 26 and large pulley 42 rotate in unison in the same direction as they are fixedly coupled to the common shaft 54.

The tension-adjusting thumb screw 34 on the charging handle 22 is configured to adjust the tension in the outboard cable 28 such that there is always a proper amount of tension in the outboard cable 28 and to avoid slack. A torsion spring 56 keeps the charging handle 22 in a home position (FIG. 4) against a stud stop 38 when not in use. The charging handle 22 is configured to rotate approximately ⅓ turn to charge the gun 10.

As shown in FIG. 4 and FIG. 5, the charging cable 40 is connected to and extends from a gun bolt stud 46 of gun 10 at one end, and is fixed to the large pulley 42 at point 44 using a quick release latch 58 (FIG. 6) at the other end of the charging cable 40. The large pulley 42 is fixed to the shaft 54. The charging cable 40 is routed into a cable housing 47 of gun 10 and is fixed to the gun bolt stud 46. Charging cable 40 pulls gun bolt stud 46 rearward. Charging cable 40 rotates around the large pulley 42 when the charging handle 22 is pulled to charge gun 10.

Figure 6:
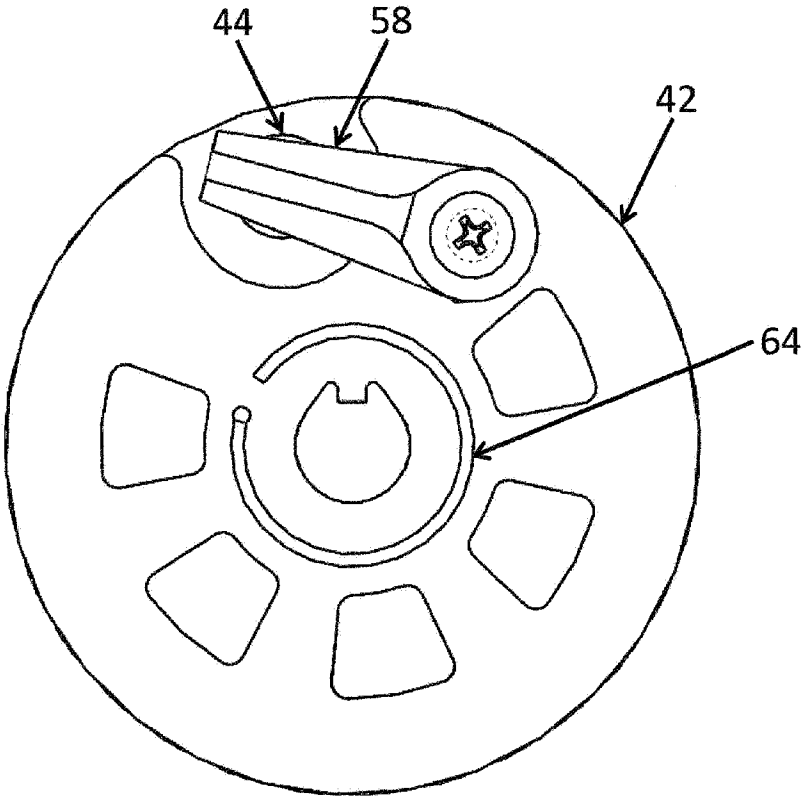
FIG. 6 illustrates the large pulley.

As shown in FIG. 5, by pulling the charging handle 22 clockwise (as viewed from the LH side), the outboard cable 28 pulls the small pulley 26, and consequently the shaft 54 and large pulley 42. Turning large pulley 42 causes the charging cable 40 to pull the gun bolt stud 46 of gun 10 rearward to charge the gun 10. FIG. 6 shows the large pulley 42 having the quick release latch 58 that allows the gun's charging cable 40 to be used. The latch 58 can pivot 90° and lock in place so that the end of charging cable 40 does not slide out when installed.

Figure 7:
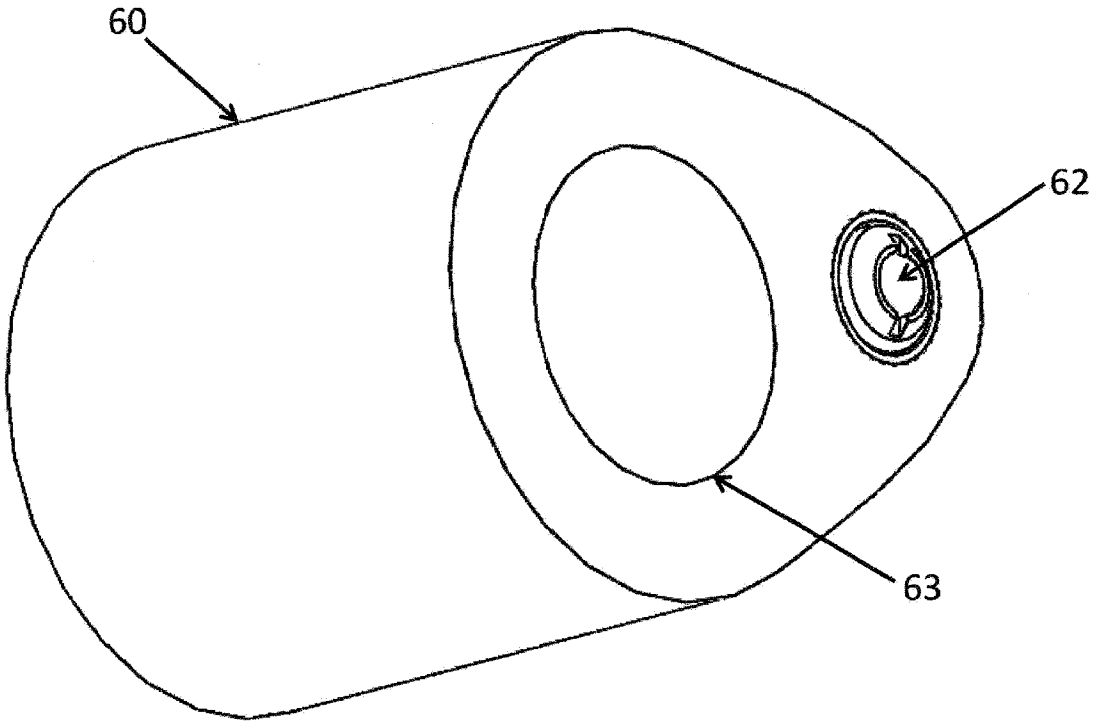
FIG. 7 illustrates an inner spacer assembly configured to locate the large pulley in its correct position to align with the gun's charging cable behind the gun bolt stud.

As shown in FIG. 3 and FIG. 7, an inner spacer assembly 60 having an opening 63 configured to receive the shaft 54 extending therethrough, such that the assembly 60 is interposed between the small pulley 26 and the large pulley 42. The assembly 60 is configured to precisely locate the large pulley 42 in its correct position to align with the gun's charging cable 40. The perimeter of the large pulley 42 is linearly aligned behind the gun bolt stud 46 and the cable housing 47, as shown in FIG. 4 and FIG. 5. The assembly 60 has a ball plunger 62 that rides in a track 64 (FIG. 6) on the large pulley 42. This ball plunger 62 is intended to keep the large pulley 42 from rotating due to tension in the outboard cable 28 when the gun's charging cable 40 is not connected to the large pulley 42. The tension from the gun's charging cable 40 is enough to offset the tension in the outboard cable 28 so there is no rotation when it is connected.

The foregoing detailed description is to be clearly understood as being given by way of illustration and example only, the spirit and scope of the present disclosure being limited solely by the appended claims.

We claim:

1. A mechanical gun charger configured to charge a gun, comprising:

a cradle configured to support a gun;

a shaft coupled to the cradle;

a first pulley coupled to the shaft and configured to receive an outboard cable around its periphery;

a second pulley coupled to the shaft and configured to receive a charging cable around its periphery, wherein the first pulley and the second pulley are configured to rotate together;

a lever rotatably coupled to the cradle;

an outboard cable coupled between the lever and the first pulley and configured such that displacement of the lever causes the first pulley, the shaft, and the second pulley to rotate; and a charging cable coupled to the second pulley and configured to couple to and charge the gun upon rotation of the second pulley.

2. The mechanical gun charger as specified in claim 1 wherein the lever includes a cam and the outboard cable is coupled to the cam.

3. The mechanical gun charger as specified in claim 2 wherein the outboard cable is routed around a portion of the cam.

4. The mechanical gun charger as specified in claim 3 wherein the outboard cable is routed around a periphery of the first pulley.

5. The mechanical gun charger as specified in claim 4 further comprising a guard disposed about the first pulley and configured to restrict the outboard cable from being removed from the periphery of the first pulley.

6. The mechanical gun charger as specified in claim 4 further comprising a tension adjuster configured to adjust a tension in the outboard cable.

7. The mechanical gun charger as specified in claim 1 wherein the charging cable is routed around a periphery of the second pulley.

8. The mechanical gun charger as specified in claim 7 wherein the charging cable is configured to couple to a gun bolt stud of the gun.

9. The mechanical gun charger as specified in claim 8 further comprising a switch configured to quickly release the charging cable from the second pulley.

10. The mechanical gun charger as specified in claim 8 wherein the charging cable is positioned on the cradle such that it is directly behind the gun bolt stud when the gun is disposed in the cradle.

11. The mechanical gun charger as specified in claim 10 further comprising a positioner configured to selectively position the second pulley in the cradle behind the gun bolt stud when the gun is disposed in the cradle.

12. The mechanical gun charger as specified in claim 11 wherein the positioner is coupled to the shaft and interposed between the first pulley and the second pulley.

13. The mechanical gun charger as specified in claim 1 wherein the first pulley has a smaller diameter than the second pulley.

14. The mechanical gun charger as specified in claim 1 further comprising a spring configured to urge the lever to a rest position when the outboard cable is not pulled.

15. The mechanical gun charger as specified in claim 1 wherein the lever is configured to be rotated towards the small pulley to responsively charge the gun.

16. A mechanical gun charger configured to charge a gun, comprising:

a cradle configured to support a gun;

a shaft coupled to the cradle;

a first pulley coupled to the shaft;

a second pulley coupled to the shaft and configured to rotate with the first pulley;

a lever having a cam and rotatably coupled to the cradle;

an outboard cable routed around the cam and the first pulley configured such that displacement of the lever causes the first pulley, the shaft, and the second pulley to rotate; and a charging cable coupled to the second pulley and configured to couple to and charge the gun upon rotation of the second pulley.

17. The mechanical gun charger as specified in claim 16 wherein the lever is configured to be rotated towards the small pulley to responsively charge the gun.

18. The mechanical gun charger as specified in claim 17 wherein the charging cable is configured to couple to a gun bolt stud of the gun such that the charging cable is directly behind the gun bolt stud when the gun is disposed in the cradle.

19. The mechanical gun charger as specified in claim 18 further comprising a positioner configured to selectively position the second pulley behind the gun bolt stud when the gun is disposed in the cradle.

20. The mechanical gun charger as specified in claim 19 wherein the first pulley has a smaller diameter than the second pulley.

* * * * *